United States Patent [19]

Ohuchi

[11] Patent Number: 4,996,964

[45] Date of Patent: Mar. 5, 1991

[54] BACKUP APPARATUS FOR IGNITION AND FUEL SYSTEM

[75] Inventor: Hirofumi Ohuchi, Himeji, Japan

[73] Assignee: Mitsubishi Denki Kabushiki Kaisha, Tokyo, Japan

[21] Appl. No.: 551,346

[22] Filed: Jul. 12, 1990

[30] Foreign Application Priority Data

Jul. 12, 1989 [JP] Japan ..... 1-181020

[51] Int. Cl.[5] ..... F02D 41/22; F02P 11/06

[52] U.S. Cl. ..... 123/479; 123/640; 123/630

[58] Field of Search ..... 123/479, 630, 640; 364/431.11

[56] References Cited

U.S. PATENT DOCUMENTS

| | | | |
|---|---|---|---|
| 3,834,361 | 9/1974 | Keely | 123/479 |
| 4,049,957 | 9/1977 | Kera et al. | 123/479 X |
| 4,310,889 | 1/1982 | Imai et al. | 123/479 X |
| 4,370,962 | 2/1983 | Hosaka | 123/479 X |
| 4,414,949 | 11/1983 | Hönig et al. | 123/479 |
| 4,653,450 | 3/1987 | Arnold et al. | 123/479 |
| 4,681,082 | 7/1987 | Onogi et al. | 123/479 X |
| 4,748,566 | 5/1988 | Sasaki et al. | 123/479 X |
| 4,750,128 | 6/1988 | Honda et al. | 123/479 X |

*Primary Examiner*—Willis R. Wolfe

*Attorney, Agent, or Firm*—Sughrue, Mion, Zinn, Macpeak and Seas

[57] ABSTRACT

A backup apparatus for ignition and fuel system provided with an ignition system backup circuit and a fuel system backup circuit to be used in case of a breakdown of a main circuit. The fuel system backup circuit outputs a drive signal to a fuel injection valve by using either an ignition signal for an ignition device from the ignition system backup circuit, or an ignition diagnosis signal from the ignition device as a trigger timing. When the ignition system backup circuit breaks down, neither the ignition signal from the ignition system backup circuit nor the ignition diagnosis signal from the ignition, device is generated, so that the supply of fuel to the engine is stopped.

10 Claims, 5 Drawing Sheets

101
8
SECOND INPUT INTERFACE CIRCUIT
MICROCOMPUTER
103
9
104
FAILURE JUDGING CIRCUIT
108
10
FIRST INPUT INTERFACE CIRCUIT
IGNITION SYSTEM BACKUP CIRCUIT
CHANGE-OVER CIRCUIT
IGNITION SYSTEM OUTPUT CIRCUIT
11
100
105
5
FUEL SYSTEM BACKUP CIRCUIT
FUEL SYSTEM OUTPUT CIRCUIT
106
107
109

8
9
101
SECOND INPUT INTERFACE CIRCUIT
MICROCOMPUTER
103
THIRD INPUT INTERFACE CIRCUIT
S1
102
FAILURE JUDGING CIRCUIT
104
108
10
FIRST INPUT INTERFACE CIRCUIT
100
IGNITION SYSTEM BACKUP CIRCUIT
105
CHANGE-OVER CIRCUIT
IGNITION SYSTEM OUTPUT CIRCUIT
11
S1
FUEL SYSTEM BACKUP CIRCUIT
106
107
FUEL SYSTEM OUTPUT CIRCUIT
109
5

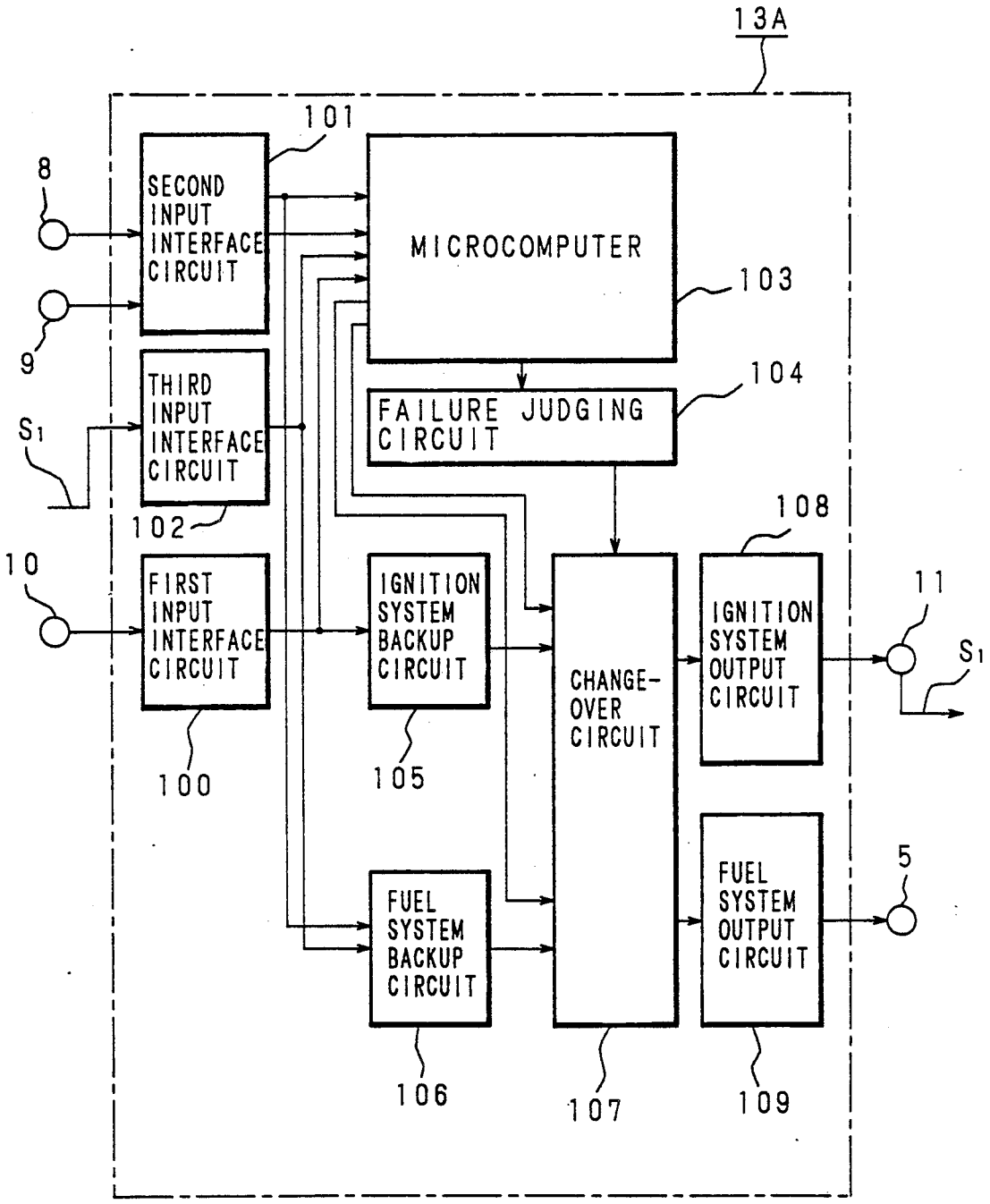
13A
101
8
SECOND INPUT INTERFACE CIRCUIT
MICROCOMPUTER
103
9
THIRD INPUT INTERFACE CIRCUIT
104
FAILURE JUDGING CIRCUIT
S1
102
108
10
FIRST INPUT INTERFACE CIRCUIT
IGNITION SYSTEM BACKUP CIRCUIT
CHANGE-OVER CIRCUIT
IGNITION SYSTEM OUTPUT CIRCUIT
11
S1
100
105
FUEL SYSTEM BACKUP CIRCUIT
FUEL SYSTEM OUTPUT CIRCUIT
5
106
107
109

BACKUP APPARATUS FOR IGNITION AND FUEL SYSTEM

BACKGROUND OF THE INVENTION

1. Field of the Invention

This invention relates to a backup apparatus for ignition and fuel system which is designed to work upon occurrence of a failure in a main circuit of the system.

2. Description of Related Art

FIG. 1 is a block diagram showing the structure of a conventional backup apparatus for ignition and fuel system, wherein an electronic control unit is encircled by a chain line. The electronic control unit is connected with a pressure sensor 8 for detecting the pressure inside an inlet pipe of an engine (not shown), a water temperature sensor 9 for detecting the temperature of cooling water in the engine, a crank angle sensor 10 for detecting a predetermined crank angle of the engine, an ignitor 11 constituting a part of the ignition device, and an electromagnetic fuel injection valve 5 for feeding a jet of fuel to the engine when it is opened.

Moreover, the electronic control unit is comprised of a first input interface circuit 100 (hereinafter referred to as a first IF100), a second input interface circuit 101 (hereinafter referred to as a second IF101), a microcomputer 103, a failure judging circuit 104, an ignition system backup circuit 105, a fuel system backup circuit 106, a changeover circuit 107, an ignition system output circuit 108 and a fuel system output circuit 109. More specifically, the first IF100 shapes waveform of an angle pulse outputted from the crank angle sensor 10, while the second IF101 removes noise components from a pressure signal of the pressure sensor 8 and a temperature signal of the water temperature sensor 9 and shapes waveforms of both signals. The microcomputer 103 outputs an ignition signal for the ignition device and a drive signal for opening the fuel injection valve 5 upon receipt of signals from the first IF100 and the second IF101. The failure judging circuit 104 judges whether the microcomputer 3 is broken or not on the basis of a watchdog signal inputted from the microcomputer 3. The ignition system backup circuit 105 generates an ignition signal and outputs it upon receipt of the angle pulse from the first IF100. On the other hand, the fuel system backup circuit 106 receives the angle pulse from the first IF100 and a pressure signal and water temperature signal from the second IF101, thereby generating a drive signal for fuel injection and outputting it to the changeover circuit 107. The changeover circuit 107 selectively outputs signal received from the microcomputer 103 or those from the ignition system backup circuit 105 and the fuel system backup circuit 106 based on an output signal of the failure judging circuit 104. Then, the ignition system output circuit 108 current-amplifies the ignition signal selected by the changeover circuit 107 and outputs it to the ignitor 11. The fuel system output circuit 109 current-amplifies the drive signal selected by the changeover circuit 107 and outputs it to the fuel injection valve 5.

The operation of the conventional backup apparatus in the above-mentioned structure will be disclosed hereinbelow in a detailed manner.

The microcomputer 103 receives the angle pulse from the crank angle sensor 10 via the first IF100 thereby to obtain the rotating number of the engine. At the same time, the microcomputer 103 calculates the ignition timing from the obtained rotating number of engine, and the supply amount of fuel based on the rotating number of engine and the pressure signal from the pressure sensor 8 via the second IF101. Thereafter, the calculated amount of fuel supply is corrected by the microcomputer 103 based on the water temperature signal from the water temperature sensor 9 via the second IF101. Thus, the microcomputer 103 sequentially outputs to the changeover circuit 107 an ignition signal satisfying the ignition timing and a drive signal for fuel injection in compliance with the corrected amount of fuel supply in synchronous manner with the angle pulse.

The ignition system backup circuit 105 generates the ignition signal and outputs it to the changeover circuit 107 in synchronous manner with the angular pulse inputted from the crank angle sensor 10 via the first IF100. The fuel system backup circuit 106 generates the drive signal for fuel injection in correspondence to the pressure signal inputted from the pressure sensor 8 via the second IF101, and outputs it to the changeover circuit 107 in synchronous manner with the angle pulse inputted from the crank angle sensor 10 via the first IF100.

The failure judging circuit 104 which receives the watchdog signal from the microcomputer 103 determines that the microcomputer 103 is operating normally so long as receiving the watchdog signal in a predetermined cycle, and outputs an "L" level signal to the changeover circuit 107. On the contrary, when the watchdog signal is interrupted or not generated at all, the failure judging circuit 104 determines the microcomputer 103 operating in failure, and outputs a "H" level signal to the changeover circuit 107. The changeover circuit 107 selects and outputs the ignition signal and drive signal from the microcomputer 103 while it receives the "L" level signal from the failure judging circuit 104. However, the changeover circuit 107 selects and outputs the ignition signal from the ignition system backup circuit 105 and the drive signal from the fuel system backup circuit 106 while it receives the "H" level signal from the failure judging circuit 104.

The ignition system output circuit 108 current-amplifies the ignition signal selected by the changeover circuit 107 and supplies it to the ignitor 11 thereby bringing about ignition. The fuel system output circuit 109 current-amplifies the drive signal selected by the changeover circuit 107 and supplies it to the fuel injection valve 5, thereby opening the valve 5.

FIG. 2 shows a block diagram of another structure of the conventional apparatus.

In FIG. 2, the same and corresponding parts to those in FIG. 1 are designated by the same references and the description thereof will be abbreviated here. When the ignitor 11 starts operating upon receipt of the ignition signal, it generates an ignition diagnosis signal $S_1$ indicating that ignition has been correctly achieved. The electronic control unit shown herein includes a third input interface circuit 102 (hereinafter referred to as a third IF102) which shapes waveform of the ignition diagnosis signal $S_1$ and then outputs the signal $S_1$ to the microcomputer 103. After having confirmed the ignition by the signal $S_1$, the microcomputer 103 generates the drive signal for fuel injection. The drive signal is not outputted by the microcomputer 103 without the confirmation of the ignition. Since the apparatus operates in the same manner as the one in FIG. 1 in other points, description will be abbreviated.

In the foregoing structure of the conventional backup apparatus for ignition and fuel system, even if the ignition backup circuit 105 breaks down when the microcomputer 103 is not operating normally, the drive signal is eventually supplied through the fuel system backup circuit 106, the changeover circuit 107 to the fuel system output circuit 109, whereby the fuel injection valve 5 is opened. As a result, the following problems arise; the fuel is undesirably accumulated in the cylinder of the engine without ignition as it is fed successively, the catalyst for purifying the exhaust gas may generate heat and break, and so forth.

SUMMARY OF THE INVENTION

This invention is devised to solve the above-described problems inherent in the conventional backup apparatus.

The characteristics of this invention are as follows:

A backup apparatus for ignition and fuel system in one aspect of this invention is characterized in the provision of an ignition system backup circuit and a fuel system backup circuit to be used in case of a breakdown of a main circuit, whereby the fuel system backup circuit utilizes an ignition signal outputted from the ignition system backup circuit as a trigger timing to output a drive signal for fuel injection.

Further, a backup apparatus for ignition and a fuel system in another aspect of this invention is characterized in the provision of an ignition system backup circuit and a fuel system backup circuit to be used in case of a breakdown of a main circuit whereby the fuel system backup circuit utilizes as a trigger timing an ignition diagnosis signal generated from an ignition device to which an ignition signal is output from the ignition system backup circuit thereby to output a drive signal for fuel injection.

Accordingly, a main object of this invention is to provide a backup apparatus for ignition and fuel system which is arranged to stop the supply of fuel in case of a breakdown of an ignition system backup circuit.

A further object of this invention is to provide a backup apparatus for ignition and fuel system which allows the engine to start again easily without the accumulation of fuel in a cylinder of the engine in case of a breakdown of an ignition system backup circuit.

A still further object of this invention is to provide a backup apparatus for ignition and fuel system which is adapted to prevent the catalyst for purifying exhaust gas from generating heat to break in case of a breakdown of an ignition system backup circuit.

The above and further objects and features of the invention will more fully be apparent from the following detailed description with accompanying drawings.

BRIEF DESCRIPTION OF THE DRAWINGS

FIG. 5 is a block diagram showing the structure of a second embodiment of this invention.

DESCRIPTION OF THE PREFERRED EMBODIMENTS

Figure 3:
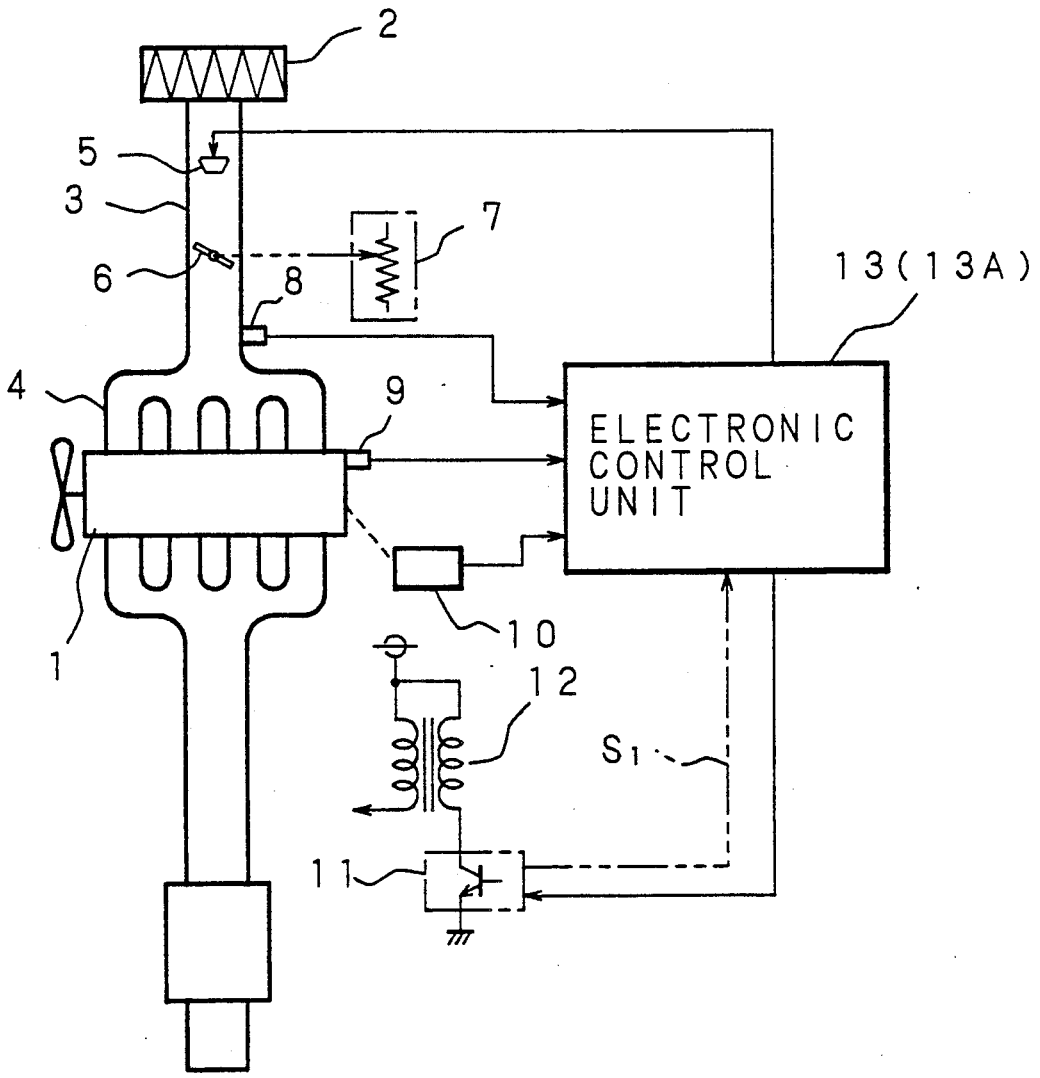
FIG. 3 is a diagram showing the structure of an engine part including a backup apparatus for ignition and fuel system according to this invention.

FIG. 3 illustrates the structure of an engine part including a backup apparatus for ignition and fuel system according to this invention. In FIG. 3, the engine 1 designator a widely known spark ignition type one mounted in an automobile for example. The air is supplied to an engine 1 via an air cleaner 2, an inlet pipe 3 and an inlet branch pipe 4, and the fuel is jet-supplied from a single electromagnetic fuel injection valve 5 provided inside the inlet pipe 3. A throttle valve 6 is provided below the fuel injection valve 5 so that the amount of air supplied to the engine 1 is adjusted through manipulation of an acceleration pedal (not shown) by a driver. The opening degree of the throttle valve 6 is detected by an opening degree sensor 7.

A pressure sensor 8 provided in the inlet pipe 3 detects the pressure within the inlet pipe 3 below the throttle valve 6 by absolute pressure, and outputs an analog pressure signal corresponding to the absolute pressure. A water temperature sensor 9 is provided in the engine 1 so as to detect the temperature of cooling water of the engine 1. Moreover, a crank angle sensor 10 is provided to generate an angle pulse every time a crank shaft of the engine 1 rotates in a predetermined angle. The angle pulse is used as a timing signal, etc. for ignition or fuel injection.

An ignition device of the engine 1 includes an ignitor 11, an ignition coil 12, a distributor (not shown), an ignition plug (not shown), etc. The ignitor 11 turns ON/OFF a primary current of the ignition coil 12 in accordance with the input ignition signal.

The electronic control unit 13 receives signals outputted from the pressure sensor 8, the water temperature sensor 9 and the crank angle sensor 10, and outputs a drive signal to open the fuel injection valve 5 and an ignition signal supplied to the ignitor 11.

Figure 4:
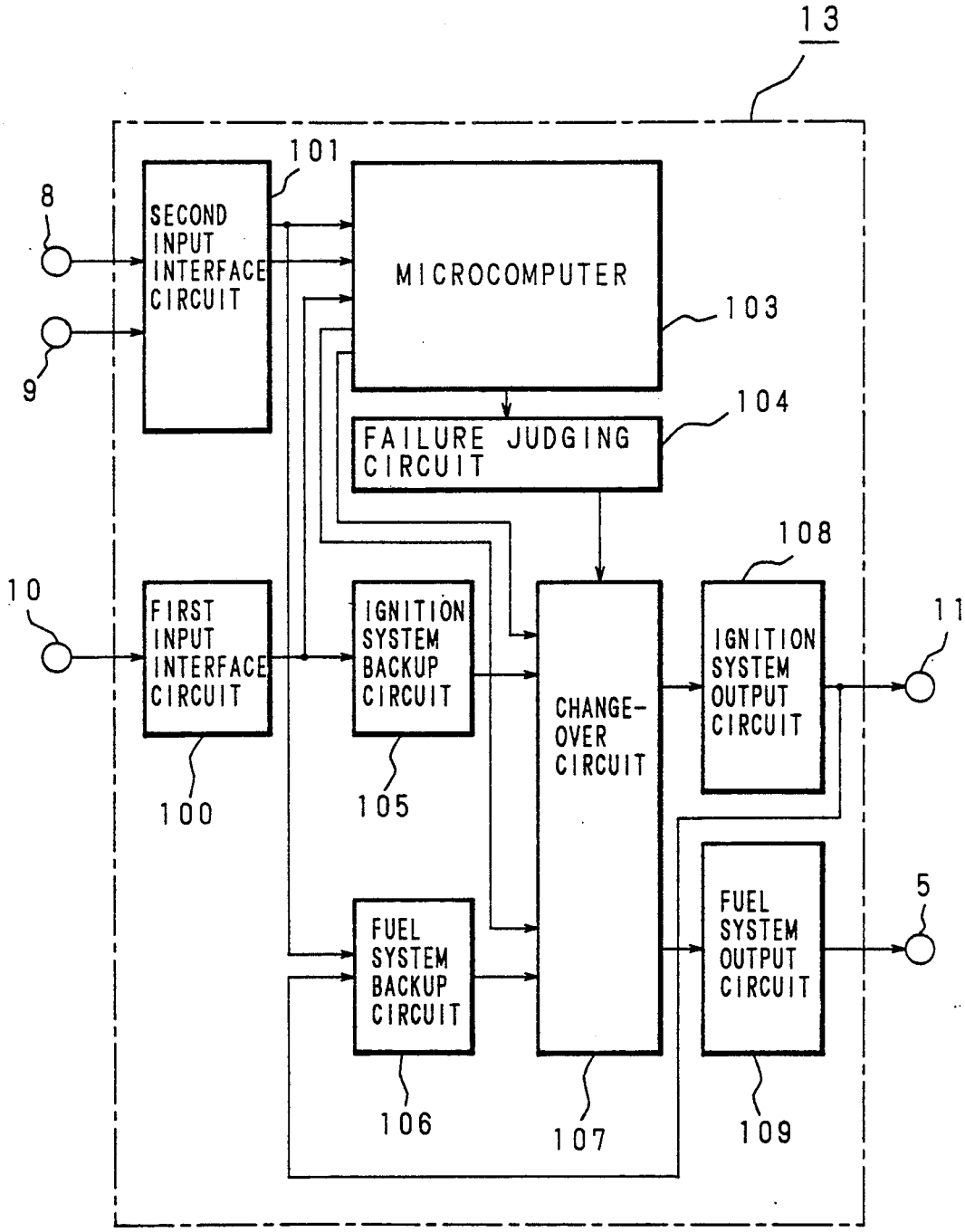
FIG. 4 is a block diagram showing the structure of a first embodiment of this invention.

The detailed structure of the electronic control unit 13 is shown in FIG. 4. The same or corresponding parts of the electronic control unit 13 to those in the conventional apparatus are designated by the same references 5, 8 to 11, 100, 101, and 103 to 109, the descriptions of which will be abbreviated here. However, an input terminal of the fuel system backup circuit 106 is connected to an output terminal of the ignition system output circuit 108, in stead of the first IF100 as in the conventional apparatus.

The operation of the backup apparatus according to the first embodiment will be discussed hereinbelow with reference to FIGS. 3 and 4.

As described earlier, the pressure sensor 8 detects the pressure inside the inlet pipe 3 below the throttle valve 6, and outputs a pressure signal corresponding to the detected absolute pressure. Meanwhile, the water temperature sensor 9 detects the temperature of cooling water of the engine 1, and outputs a water temperature signal corresponding to the detected temperature of the water. The crank angle sensor 10 generates an angle pulse every time the crank shaft of the engine 1 rotates in a predetermined angle. The electronic control unit 13 uses these three signals from the pressure sensor 8, the water temperature sensor 9 and the crank angle sensor 10 selectively, thereby outputting an ignition signal to the ignitor 11 and a drive signal for fuel injection to the fuel injection valve 5. Consequently, the ignitor 11 interrupts the primary current of the ignition coil 12 to let the ignition plug spark, whereby the engine 1 starts operating. The fuel injection valve 5 jets out the fuel when the drive signal is supplied. The fuel is added with the air of the corresponding amount to the opening degree of the throttle valve 6 through the air cleaner 2, inlet pipe 3 and inlet branch pipe 4, thereby composing a mixture gas to be fed to the engine 1.

Figure 1:
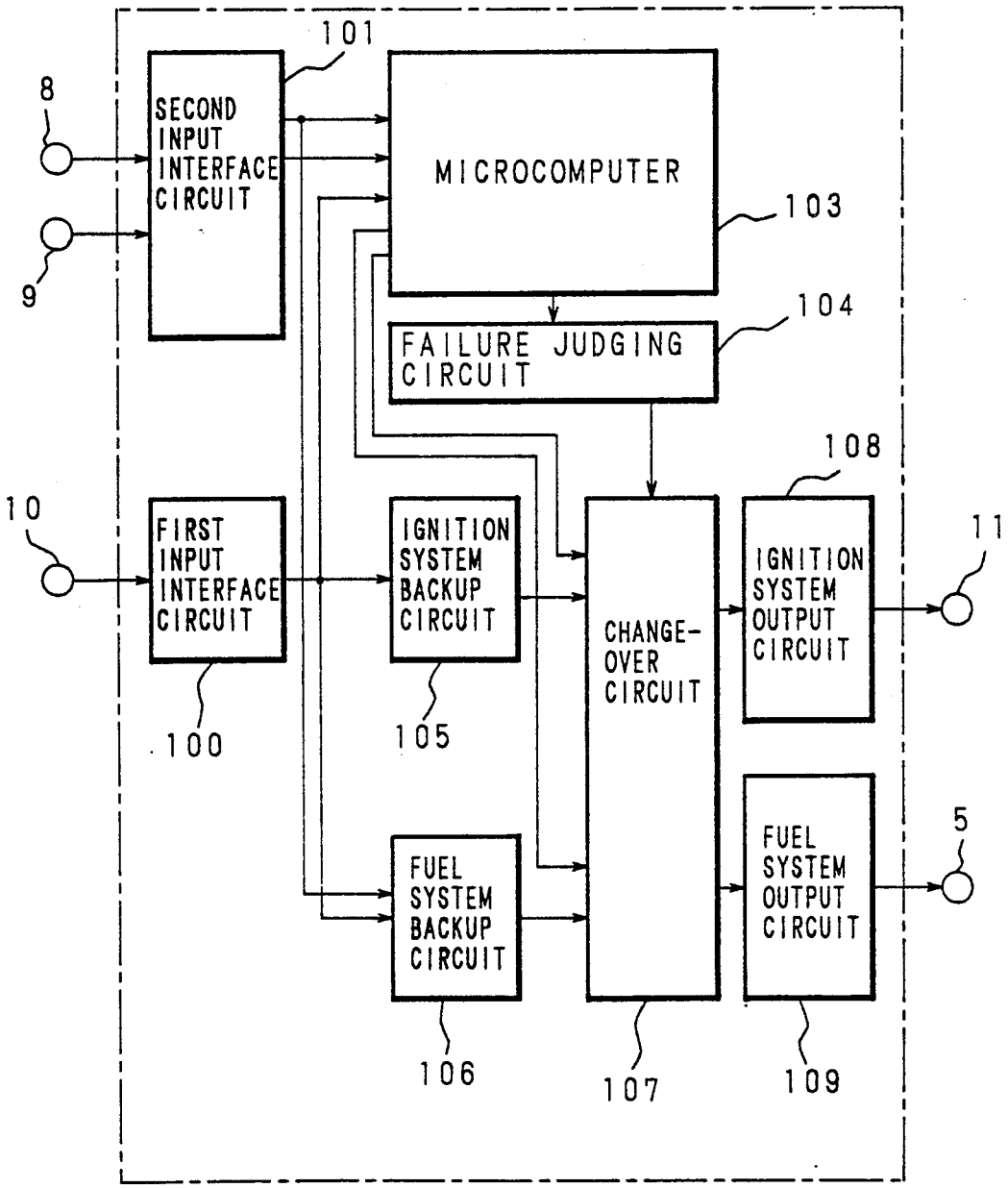
FIG. 1 is a block diagram showing one example of the structure of a conventional backup apparatus for ignition and fuel system.

Since the main operation of the electronic control unit 13 is substantially described in the explanation of FIG. 1, only its difference from the conventional one will be stated now. When the microcomputer 103 is in failure, the ignition signal outputted from the ignition system backup circuit 105 is supplied to the ignitor 11 through the changeover circuit 107 and the ignition system output circuit 108. The fuel system backup circuit 106 outputs the drive signal for fuel injection by using the ignition signal from the ignition system output circuit 108 as a trigger timing. If the ignition system backup circuit 105 goes wrong during the breakdown of the microcomputer 103, the ignition signal is not generated from the ignition system backup circuit 105. Therefore, the fuel system backup circuit 106 becomes unable to receive the ignition signal from the ignition system output circuit 108, thereby outputting no drive signal for fuel injection. At this time, the fuel injection valve 5 is accordingly not supplied with the drive signal, so that the supply of fuel is stopped.

FIG. 5 illustrates the structure of the second embodiment of an electronic control unit 13A of this invention. As indicated also in FIG. 3, the electronic control unit 13A inputs an ignition diagnosis signal $S_1$ from the ignitor 11. The same or corresponding parts in the control unit 13A to those in the conventional apparatus are designated by the same references 5, 8 to 11 and 100 to 109, and the descriptions thereof will be abbreviated. However, the fuel system backup circuit 106 is not connected to the first IF100, but to the third IF102 so that the ignition diagnosis signal $S_1$ is inputted from the ignitor 11.

Figure 2:
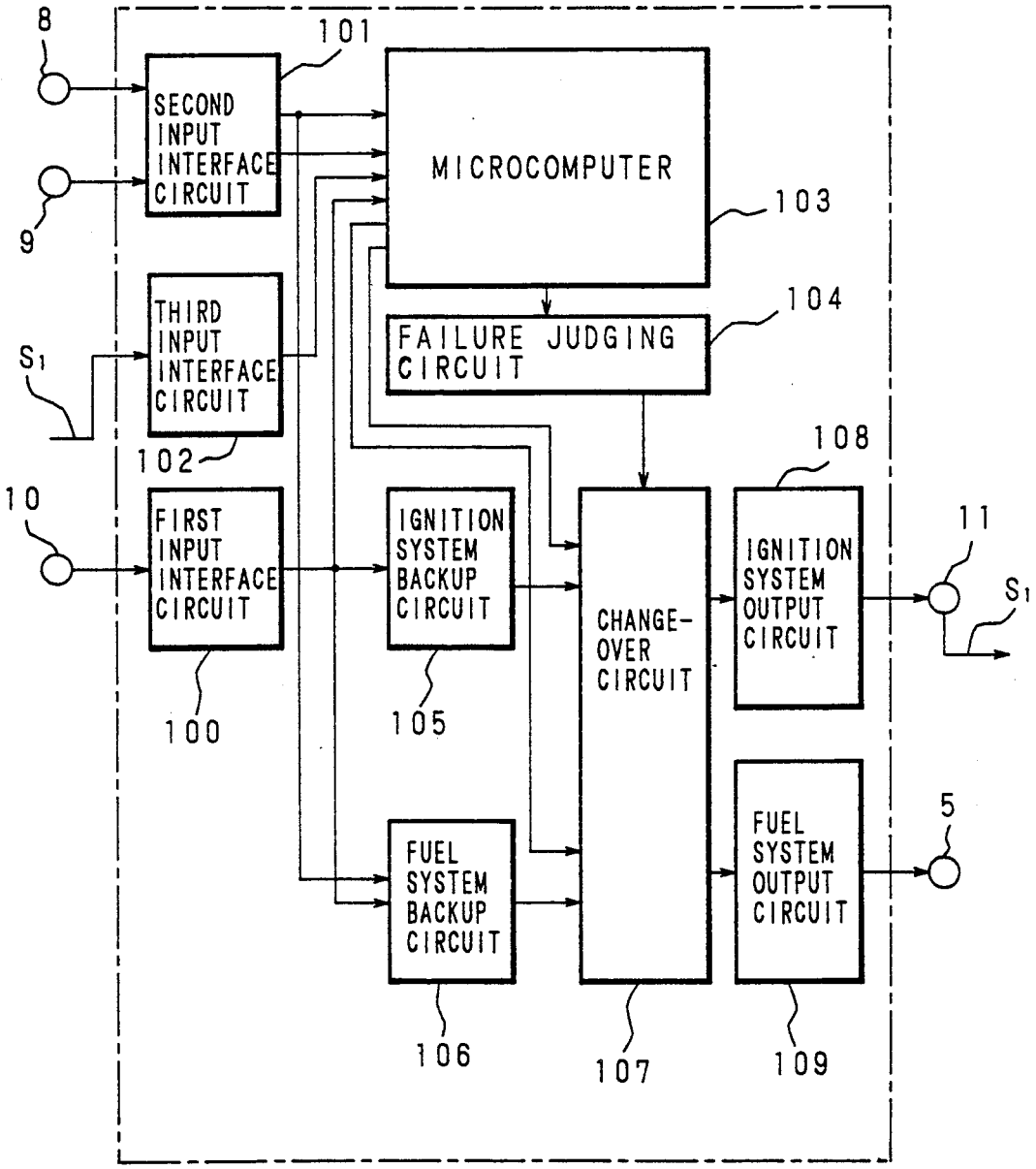
FIG. 2 is a block diagram showing another example of the structure of the conventional backup apparatus for ignition and fuel system.

The operation of the backup apparatus, specifically, electronic control unit 13A will be described with reference to FIG. 5. Since the main operation of the apparatus is already described in the explanation of FIG. 2, only the difference from the conventional one will be stated hereinbelow. When the microcomputer 103 is broken, the ignition signal outputted from the ignition system backup circuit 105 is inputted to the ignitor 11 through the changeover circuit 107 and the ignition system output circuit 108. The fuel system backup circuit 106 outputs the drive signal for fuel injection, using an ignition diagnosis signal $S_1$ inputted via the third IF102 as a trigger timing. If the ignition backup circuit 105 goes wrong during a breakdown of the microcomputer 103, the ignition signal is not generated from the ignition system backup circuit 105, and therefore not supplied to the ignitor 11. Accordingly, the ignition diagnosis signal $S_1$ is not generated from the ignitor 11. Since the drive signal for fuel injection can not be outputted from the fuel system backup circuit 106 so long as the ignition diagnosis signal $S_1$ is not inputted to the circuit 106. Consequently the fuel injection valve 5 will not be opened, thereby the supply of fuel to the engine 1 will be stopped.

It is to be noted here that although a signal from the ignitor 11 is utilized as the ignition diagnosis signal $S_1$, a primary signal of the ignition coil 12 can be used, too, for the same effect.

In any of the foregoing embodiments, the supply amount of fuel is determined in accordance with the pressure, but it may be determined in accordance with the opening degree of the throttle valve 6.

Furthermore, although the foregoing embodiments are related to a D-jetro system engine, this invention is applicable to an L-jetro system engine as well.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the meets and bounds of the claims, or equivalence of such meets and bounds thereof are therefore intended to be embraced by the claims.

What is claimed is:

1. A backup apparatus for ignition and fuel system which is designed to backup an ignition and a fuel systems of an engine in case of a breakdown of a main circuit which generates an ignition signal to an ignition device and a drive signal to a fuel injection valve on the basis of data indicative of the operating state of said engine, comprising:

an ignition system backup circuit which generates and supplies an ignition signal to said ignition device on the basis of said data in case of a breakdown of said main circuit; and a fuel system backup circuit which generates and supplies a drive signal to said fuel injection valve on the basis of said data in case of a breakdown of said main circuit;

wherein said fuel system backup circuit outputs said drive signal by using said ignition signal outputted from said ignition system backup circuit as a trigger timing.

2. A backup apparatus for ignition and fuel system as claimed in claim 1, further comprising a judging circuit for judging whether said main circuit is broken or not.

3. A backup apparatus for ignition and fuel system as claimed in claim 2, further comprising a changeover circuit which receives said ignition signal and drive signal from said main circuit, said ignition signal from said ignition system backup circuit and said drive signal from said fuel system backup circuit, and outputs these inputted signals to said ignition device and fuel injection valve.

4. A backup apparatus for ignition and fuel system as claimed in claim 3, wherein said changeover circuit selectively outputs said ignition signal and drive signal from said main circuit or said ignition signal from said ignition system backup circuit and said drive signal from said fuel system backup circuit on the basis of a failure judging signal from said judging circuit.

5. A backup apparatus for ignition and fuel system as claimed in claim 1, wherein said data includes the angle of a crank shaft of said engine, pressure inside an inlet pipe of said engine and temperature of cooling water of said engine.

6. A backup apparatus for ignition and fuel system which is designed to backup an ignition and a fuel systems of an engine in case of a breakdown of a main circuit which generates an ignition signal to an ignition device and a drive signal to a fuel injection valve on the basis of data indicative of the operating state of said engine, with receiving an ignition diagnosis signal from said ignition device, comprising:

an ignition system backup circuit which generates and supplies an ignition signal to said ignition device on the basis of said data in case of a breakdown of said main circuit; and a fuel system backup circuit which generates and supplies a drive signal to said fuel injection valve on the basis of said data in case of a breakdown of said main circuit;

wherein said fuel system backup circuit outputs said drive signal by using said ignition diagnosis signal as a trigger timing.

7. A backup apparatus for ignition and fuel system as claimed in claim 6, further comprising a judging circuit for judging whether said main circuit is broken or not.

8. A backup apparatus for ignition and fuel system as claimed in claim 7, further comprising a changeover circuit which receives said ignition signal and drive signal from said main circuit, and said ignition signal from said ignition system backup circuit and said drive signal from said fuel system backup circuit, and outputs these inputted signals to said ignition device and fuel injection valve.

9. A backup apparatus for ignition and fuel system as claimed in claim 8, wherein said changeover circuit selectively outputs said ignition signal and drive signal from said main circuit or said ignition signal from said ignition system backup circuit and said drive signal from said fuel system backup circuit on the basis of a failure judging signal from said judging circuit.

10. A backup apparatus for ignition and fuel system as claimed in claim 6, wherein said data includes the angle of a crank shaft of said engine, pressure inside an inlet pipe of said engine and temperature of cooling water of said engine.

* * * * *